US005249883A

United States Patent [19]

Watson et al.

[11] Patent Number: 5,249,883

[45] Date of Patent: Oct. 5, 1993

[54] METAL PLATE/ASPHALT PAVEMENT

[75] Inventors: Ronald D. Watson; Dennis P. Foley; Reginald Frizzell; Dale Sieben; Ludovit Zanzotto, all of Calgary, Canada

[73] Assignee: Husky Oil Operations Ltd., Calgary, Canada

[21] Appl. No.: 845,137

[22] Filed: Mar. 26, 1992

[51] Int. Cl.[5] ..... E01C 5/22

[52] U.S. Cl. ..... 404/31

[58] Field of Search ..... 404/31, 70

[56] References Cited

U.S. PATENT DOCUMENTS 2,246,101 1/1938 McEnany ..... 404/31 X
2,718,829 9/1955 Seymour et al. ..... 404/31

FOREIGN PATENT DOCUMENTS 200873 1/1983 Czechoslovakia .
200874 1/1983 Czechoslovakia .
207876 12/1983 Czechoslovakia .
207877 12/1983 Czechoslovakia .

*Primary Examiner*—William P. Neuder
*Attorney, Agent, or Firm*—Stevens, Davis, Miller & Mosher

[57] ABSTRACT

A combination of a metal plate and a four layer paving system includes:

(a) a metal plate;
(b) a first primer layer, consisting of an elastomer modified asphalt;
(c) an aggregate layer;
(d) a second primer layer, consisting of an elastomer modified asphalt; and
(e) a layer of asphalt pavement.

The combination is resistant to delamination between the metal plate and the paving system. It may be utilized in applications which are subjected to the load of automotive traffic, such as bridge decking or the flooring of a parking garage.

9 Claims, 1 Drawing Sheet

METAL PLATE/ASPHALT PAVEMENT

FIELD OF THE INVENTION

The present invention relates to a combination of a flat metal plate and a four-layer paving composition which covers the metal plate. The combination is resistant to delamination between the paving and the metal plate, when placed under a load.

This invention may be suitably utilized in a wide variety of applications, including flooring material (such as the floor of an automobile parking garage) and/or bridge decking.

BACKGROUND OF THE INVENTION

The use of asphalt as a corrosion resistant paint (or coating) for metal pipes/plates is known.

However, in contrast, asphalt pavement is generally not suitable as a "paving" material when used on top of a load bearing metal plate. In particular, asphalt pavement which is paved onto a metal is liable to crack and/or delaminate from the plate when placed under a load (such as the load caused by automotive traffic).

It has been proposed to alleviate the above described cracking/delamination problems associated with asphalt paving/metal plate compositions through the use of an epoxy-modified asphalt, as disclosed in Czechoslovakian patents 200,873 (1980); 207,877 (1981); and 200,874 (1980). However, epoxy-modified asphalt is comparatively expensive, and the techniques of the above Czechoslovakian patents have not enjoyed widespread commercial success.

SUMMARY OF THE INVENTION

The present invention provides a combination of a metal plate and a four-layer paving system, said four layer paving system consisting of:

(a) a first layer which is applied to the top surface of said metal plate, said first layer having sufficient tack to adhere to said metal plate and comprising a first elastomer-modified asphalt composition containing from 6 to 25 weight percent first elastomer and 94 to 80 weight percent first asphalt, wherein said first elastomer-modified asphalt composition is:
  (i) prepared with first asphalt having a penetration value of from 15 to 800,
  (ii) applied in the form of a first emulsion, in an amount sufficient to provide from 400 g to 1800 g of said first elastomer-modified asphalt composition per square meter, (b) a second layer consisting of aggregate particles having a maximum size of 15 mm, said second layer being applied over said first layer in an amount of from 5 to 15 kg per square meter, (c) a third layer which is applied over said second layer, said third layer comprising of a second elastomer-modified asphalt composition consisting of 3 to 20 weight percent second elastomer and 97 to 80 weight percent second asphalt, wherein said second elastomer-modified composition is:
  (i) prepared with second asphalt having a penetration value of from 15 to 800,
  (ii) applied in the form of a second emulsion, in an amount sufficient to provide from 100 g to 1200 g of said second elastomer-modified composition per square meter, and (d) a fourth layer consisting of asphalt pavement, said fourth layer having a minimum thickness of 10 mm.

DETAILED DESCRIPTION

Figure 1:
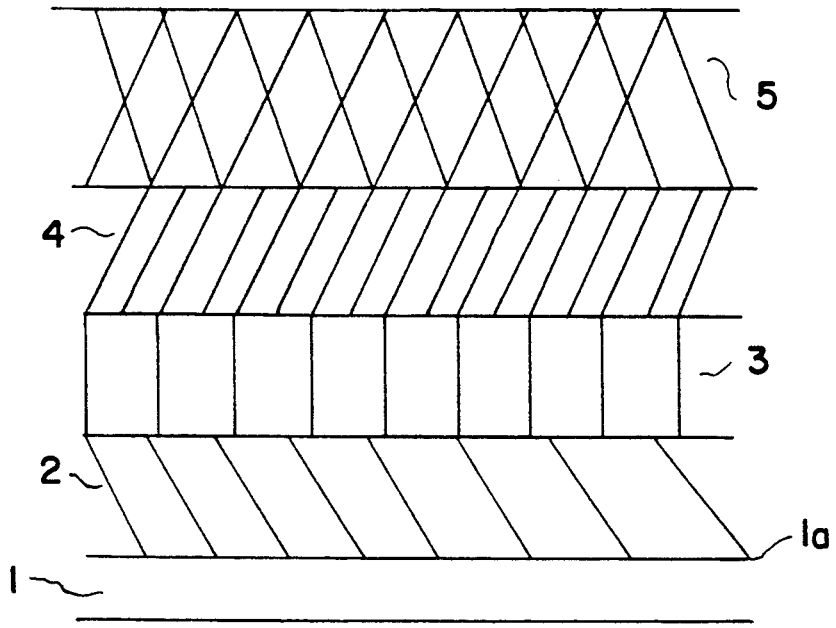
FIG. 1 is a sectional view of the combination of the present invention.

Referring to FIG. 1, the top surface 1*a* of a generally flat metal plate 1 is coated with first primer layer 2. A layer of aggregate 3 is coated on the top of first primer layer 2. The aggregate layer 3 is coated with second primer layer 4. A layer of asphalt pavement 5 is paved on top of the second primer layer 4.

The metal plate 1, the first primer layer 2, the aggregate layer 3, the second primer layer 4 and the asphalt pavement 5 are described in detail below.

Metal Plate

The metal plate 1 is a conventional metal plate of the type which is used for example, in metal flooring applications. The dimensions of the plate 1 are not critical to the success of the present invention, and it is desirable to use commercially available plates for convenience. Such plates generally have maximum dimensions of less than 10 m×2 m (for ease of handling). The top surface 1*a* may be treated (e.g. plated for corrosion resistance) by the plate manufacturer. It is preferred to utilize a plate having a thickness from 0.5 to 4 cm (for cost consideration), and a zinc-containing plating on the top surface.

A plurality of the plates may be attached together to form a large surface. This large surface may then be covered by the four layer paving system which is described in detail below. Alternatively, but less preferably, the plates may be individually covered with the four layer paving system, then installed in a plate-by-plate manner. Either of the above alternatives may be used to prepare a surface which can be subjected to the load of automotive traffic, such as the floor of an automotive parking garage.

First Layer (or "First Primer Layer")

Referring again to FIG. 1, the first primer layer 2 is applied to the top surface 1*a* of the metal plate 1.

The first primer layer generally consists of elastomer-modified asphalt having sufficient tack to adhere to the metal plate.

The term asphalt is meant to refer to its conventional meaning, namely a dark coloured cementitious material that contains high molecular weight hydrocarbons which are commonly referred to as asphaltenes. Asphalt may be directly obtained from natural sources (i.e. native asphalt including "Trinidad Asphalt", rock asphalt or lake asphalt) or from the refining of petroleum (i.e. "petroleum" asphalt). The source of asphalt is not critical to the success of this invention, although petroleum asphalt is preferred because it is readily available. The term petroleum asphalt is meant to include primary asphalt (i.e. a product of the vacuum distillation of hydrocarbon oil), oxidized asphalt (including those asphalts known by the terms "blown asphalt" and/or "semi-blown asphalt"), cracking asphalt (i.e. asphalt obtained from cracking operations) and solvent extracted asphalt (such as propane-extracted asphalt).

Primary asphalt and oxidized asphalt are particularly preferred for use in this invention. Further detailed description of asphalt may be obtained from the open literature (including volume 3 of the third edition of the "Encyclopedia of Chemical Technology", Kirk-Othmer Editors, ISBN 0-471-0239-7). Asphalt is commonly characterized according to "penetration value" (or "pen value"), which is determined by the standard test method ASTM D5. Pen value is expressed in units of dmm (although reference to these units is often not explicitly given). The ASTM test procedures were completed at a temperature of 25° C., using a 100 g needle for a period of 5 seconds. Asphalt having a penetration value of from 15 to 800 dmm is suitable for use in the present invention and a pen value between 200 and 600 dmm is preferred.

The elastomer-modified asphalt composition of the first layer contains from 6 to 25 weight percent elastomer and preferably contains from 8 to 13 weight percent elastomer. The type of elastomer is not critical to the success of the present invention. Examples of suitable elastomers include natural rubber, emulsion polymerized styrene-butadiene rubber, styrene-diene thermoplastic block rubber, ethylene-propylene copolymer rubber, isobutylene-isoprene copolymer rubber, polyisobutylene rubber, polybutadiene rubber, butadiene-acrylonitrile copolymer rubber, ethylene-vinyl acetate rubber and mixtures thereof.

The preferred elastomer is a styrene-diene thermoplastic block rubber, such as styrene-butadiene diblock (or "SB") rubber, styrene-butadiene-styrene (or "SBS") rubber. This type of elastomer is well known and is described in the open literature (particularly in volume 8 of the aforesaid "Kirk-Othmer" Encyclopedia (ISBN 0-471-02044-3). For the purpose of the present invention, an SBS rubber, having a bound styrene content of from 20 to 40 weight percent, is especially suitable. More than one elastomer may be used in the preparation of the elastomer modified asphalt. The use of more than one elastomer may, for example, improve the ease of preparing the elastomer-modified asphalt composition.

As noted above, it is essential that the first primer layer has sufficient tack to adhere to the metal. While certain elastomer-modified asphalts compositions do inherently have the required tack, it is highly preferred to incorporate a minor amount of tackifier (from 0.1 to 2 weight percent) to ensure good adhesion to the metal plate. Terpene-resin type tackifiers are preferred.

The first primer layer may also include other ingredients which are conventionally utilized in elastomer-modified asphalt compositions, including extenders such as oil, sulfur and antioxidants.

The use of a small amount of oil (from 5 to 20 weight percent of the elastomer-modified asphalt) is a desirable way to enhance the flexibility of the first primer layer at a comparatively low cost, while the use of a very small amount of sulfur (from 0.07 to 2.0 weight percent) can increase elastomer/asphalt compatibility.

The ingredients of the first primer layer are mixed together using conventional mixing techniques, preferably in a high shear mixer. The resulting "first primer layer" composition is viscous and is difficult to apply to the metal plate. Accordingly, the composition is emulsified in order to improve the ease of application. The emulsion is prepared by intensively mixing at elevated temperatures the elastomer-modified asphalt with water and an emulsifier (e.g. a soap or detergent) so as to produce a finely "emulsified dispersion" of the elastomer-modified asphalt in the water. Conventional techniques for the preparation of asphalt emulsions are well known to those skilled in the art and are suitable for use in the present invention. A detailed description of such techniques is given in volume 3 of the aforesaid "Kirk-Othmer" reference.

The type of emulsifier used to prepare the emulsion is not critical, but soaps prepared with "tall oil" (i.e. a mixed fatty/rosin acid material, derived from coniferous trees) have been used with favourable results. A soap prepared by the saponification of tall oil with NaOH is particularly preferred for reasons of cost and convenience. This soap is commonly referred to as the sodium salt of tall oil.

The emulsion can be characterized according to the amount of elastomer-modified asphalt it contains (i.e. the "solids content"). The term "solids content" is defined by the formula:

$$\text{solids content (weight \%)} = \frac{\text{weight of elastomer modified asphalt}}{\text{total weight of emulsion}} \times 100\%$$

The emulsion is applied to the top surface of the metal plate in an amount sufficient to provide from 400 to 1800 g (preferably from 500 g to 900 g) of elastomer-modified asphalt per $m^2$ (i.e. square meter). Amounts less than 400 $g/m^2$ do not provide satisfactory results, while amounts greater than 900 $g/m^2$ would represent an over-use of the comparatively expensive first primer layer.

By way of example, the application of 1 kg of emulsion having a solids content of 60% to one square meter of plate would provide a coating of 600 g of the elastomer-modified asphalt per $m^2$.

Second Layer (or "Aggregate Layer")

The second layer (layer 3 in FIG. 1) consists of aggregate which is applied on top of the first primer layer (i.e. on top of layer 2, as shown in FIG. 1). The aggregate particles should have a maximum particle size of less than 15 mm (i.e. the particles will pass through a screen having a screen size of 15 mm), and preferably will have a maximum particle size of less than 10 mm, so that the aggregate is well wetted by the first primer layer. Highly preferred aggregate consists of gravel or stones having a particle size distribution which is further characterized by containing less than 20 weight percent of fines (i.e. "fines" are particles that will pass through a sieve of 75 microns).

The aggregate is applied on top of the first primer layer in a manner that provides a thin layer of fairly uniform thickness. When using a conventional stone aggregate having the above described highly preferred size distribution, the amount of aggregate employed is from 8 to 15 kg per $m^2$ of surface area.

The aggregate may be rolled into the first primer layer to enhance contact between the two. It is desirable to allow the aggregate layer to sit for at least eight hours before the next layer is applied.

Third Layer (or "second Primer Layer")

The third layer, also referred to herein on occasion as the second primer layer, is located in the position indicated by reference numeral 4 in FIG. 1.

The third layer generally consists of an elastomer-modified asphalt composition which contains from 3 to 20 weight percent elastomer (preferably from 5 to 9 weight percent elastomer).

The composition of this layer (which may be referred to as the second elastomer-modified asphalt composition, so as to distinguish it from the composition of the first layer) preferably contains less elastomer than that of the first layer for reasons of economy, but in other respects, the compositions of the first and third layers are similar.

In particular, the elastomer(s), asphalt and additives used in the first layer composition may also be used in the third layer. The third layer is applied as an emulsion (preferably having a solids content of from 40 to 70 weight percent) in an amount sufficient to provide from 100 to 1200 g (preferably 200 g to 400 g) of the second elastomer-modified asphalt composition per $m^2$.

It is preferable to "roll" the third layer (so as to provide good contact with the aggregate layer) and to allow the so-rolled layer to sit for at least 8 hours before applying the fourth layer.

The above described first layer, second layer and third layer have been found to provide, in combination, a "foundation" on which asphalt pavement (the fourth layer) may suitably be applied. While not wishing to be bound by any particular theory, it is believed that the combination of the flexible primer layers (i.e. the first and third layers) with the aggregate layer serves to mitigate cracking and delamination problems which might otherwise result from the localized stresses caused by deflection of the metal plate.

Fourth Layer

The fourth layer (reference numeral 5 in FIG. 1) consists of asphalt pavement. The term asphalt pavement is meant to include all asphalt-containing paving materials which may be used to construct roads.

Asphalt pavement typically consists of a minor amount of "asphalt binder" (from 4 to 12 weight percent) and a major amount of mineral aggregate (from 95 to 88 weight percent). Asphalts having a wide range of penetration values are known to be suitable for preparing pavement, although pen values of from 15 to 800 (especially 65 to 600) are preferred.

The fourth layer has a thickness of at least 1 cm as a thinner layer typically does not have sufficient durability. A thickness between 2 and 10 cm is preferred. Although it is not intended to limit this invention to the use of any particular asphalt pavement, it is highly preferred to employ elastomer-modified asphalt in the preparation of the pavement. In particular, the elastomer-modified asphalt compositions which are used in the third layer, may suitably be utilized as the asphalt binder component of the fourth layer asphalt pavement.

As a note of clarification, it will be apparent that the amount of elastomer in such preferred pavement compositions is quite small, as the elastomer is present as a minor constituent of the asphalt, and the asphalt is itself only a minor constituent of the pavement.

The use of any particular type of mineral aggregate is not critical to this invention. The term "mineral aggregate" is meant to have broad meaning (and is used in the context of the present invention primarily to distinguish it from the more narrowly defined term "aggregate" as employed in the description of the aggregate layer). The size of mineral aggregate commonly used in the paving industry to prepare roads and the like is suitable for use in the asphalt pavement of this invention.

EXAMPLES

The invention is illustrated in further detail by the following non-limiting examples in which all references to percentage are by weight, unless otherwise indicated.

EXAMPLE 1

This example illustrates the preparation of a preferred first primer layer.

The ingredients shown in Table 1 were mixed for 90 minutes in a conventional, laboratory-size high shear mixer.

The mixer was obtained from the Charles Ross and Son Company of Hauppauge, N.Y., and is referred to as a Ross 100 LX mixer. The mixer has a 1 horsepower motor, a drive which operates at 3600 rpm and a mixing assembly which was designed to accommodate a standard 5 U.S. gallon pail (i.e. a pail having a capacity of about 19 l).

The resulting elastomer-modified asphalt composition was then emulsified using the sodium salt of tall oil as emulsifier.

The final emulsion had a solids content of about 55%.

TABLE 1

| Ingredient | Amount (weight %) |
|---|---|
| S-B-S Elastomer - 1[a] | 5 |
| S-B-S Elastomer - S[b] | 6 |
| Oil | 8 |
| Antioxidant[c] | 0.5 |
| Tackifier[d] | 0.5 |
| Asphalt[e] | 80 |

Notes:
[a]S-B-S block thermoplastic elastomer having a reported bound styrene content of about 30 weight percent (sold by Fina Oil and Chemical Company ("Fina") under the trademark Finaprene 411).
[b]S-B-S block thermoplastic elastomer having a reported bound styrene content of about 25 weight percent (sold by Fina under the trademark Finaprene 1205).
[c]Antioxidant composition, believed to be tri (mixed mono and dinonylphenyl phosphite) sold under the trademark Polygard HR by Uniroyal Chemical Company).
[d]Proprietary composition, believed to be based on terpene resin, sold under the tradename SP-553 by Schenectady Chemicals, Inc.).
[e]having a pen value of 300 to 400 (ASTM D5, at 25° C.).

EXAMPLE 2

This example illustrates the preparation of a preferred third layer composition.

The ingredients shown in Table 2 were mixed for 120 minutes in Ross 100-LX mixer described in Example 1.

The resulting second elastomer-modified asphalt composition was then emulsified using the sodium salt of tall oil as emulsifier.

The emulsion had a solids content of about 60 weight percent.

TABLE 2

| Ingredient | Amount (weight %) |
|---|---|
| S-B-S Elastomer - 3[a] | 7.00 |
| Sulfur | 0.12 |
| Asphalt[b] | 92.88 |

Notes:
[a]S-B-S block thermoplastic elastomer having a reported bound styrene amount of about 30 weight percent (sold by Fina under the trademark Finaprene 416).
[b]pen value of 300–400 (ASTM D5, at 25° C.).

EXAMPLE 3

This example illustrates the preparation of an asphalt pavement composition.

Elastomer-modified asphalt having the composition shown in Table 2 of Example was used as the "asphalt binder".

An asphalt pavement was then prepared by hot-mixing 8 weight percent of the elastomer-modified asphalt composition of Table 2, together with 92 weight percent of graded mineral aggregate. In general, the mineral aggregate can be described as a mixture of equal parts of coarse sand and a finer sand.

EXAMPLE 4

This example illustrates the preparation of three separate "metal plate/four layer paving" combinations according to the present invention (designated as Plates A, B and C in Table 3).

The metal plates had dimensions of about 30 cm×90 cm (width×length) and a thickness of about 0.8 cm.

The procedures used to prepare each of the combinations are described below.

1. Initially, a first layer (having the composition described in Example 1) was applied to the plates as an emulsion in the amounts indicated in Table 3.
2. An aggregate layer was then applied on top of the first layer. The aggregate was applied in an amount of 11 kg/m$^2$ at a temperature of 70° C.
3. The aggregate was then rolled (i.e. with a roller, to embed the aggregate into the first layer).
4. After 24 hours, the third layer (having the composition described in Example 2) was applied as an emulsion in the amounts indicated in Table 3. The third layer was applied at a temperature of about 70° C.
5. After a further 24 hours, asphalt pavement (having the composition described in Example 3) as applied over top of the third layer. The asphalt pavement was then rolled with a steel roller at a temperature estimated to be between 110° and 130° C. The thickness of the asphalt pavement layer was 2 cm.

After another 24 hour period, Plate C was subjected to simulated vehicle traffic at 15° C.

Plate C was placed under the front-left wheel of a van (i.e. a light truck), then, while the van was stationary, the front wheels were turned (i.e. a dry steering test, to cause a shear force on the plate).

In another test, Plate C was elevated by placing a wood strip, having a thickness of about 4 cm, under the opposite (lengthwise) ends. The van was then driven over the plate, resulting in a deflection of the plate.

At a later date, Plate C was subjected to the above described simulated vehicle traffic test at an ambient temperature of −20° C.

None of the tests described above produced visible cracks in the pavement or visible delamination of the paving layers from the metal plate.

In a final series of tests, Plate C was heated in an oven at a temperature of 50° C., then immediately taken outside and subjected in sequence to the above described dry steering and deflection tests. One test observer believed that the asphalt moved slightly on the metal plate during the dry steering test. However, at the completion of the two tests, there was no visible delamination of the paving layers from the metal plate, and the pavement was not visibly cracked.

The embodiments of the invention in which an exclusive property or privilege is claimed are defined as follows:

1. A combination of a metal plate and a four-layer paving system, said four layer paving system consisting of:

(a) a first layer which is applied to the top surface of said metal plate, said first layer having sufficient tack to adhere to said metal plate and comprising a first elastomer-modified asphalt composition consisting of from 6 to 25 weight percent first elastomer and 94 to 75 weight percent first asphalt, wherein said first elastomer-modified asphalt composition is:
  (i) prepared with first asphalt having a penetration value of from 15 to 800 dmm,
  (ii) applied in the form of a first emulsion, in an amount sufficient to provide from 400 g to 1800 g of said first elastomer-modified asphalt composition per square meter, (b) a second layer consisting of aggregate particles having a maximum size of 15 mm, said second layer being applied over said first layer in an amount of from 5 to 15 kg per square meter, (c) a third layer which is applied over said second layer, said third layer comprising a second elastomer-modified asphalt composition consisting of from 3 to 20 weight percent second elastomer and 97 to 80 weight percent second asphalt, wherein said second elastomer-modified composition is:
  (i) prepared with second asphalt having a penetration value of from 15 to 800 dmm,
  (ii) applied in the form of a second emulsion, in an amount sufficient to provide from 100 g to 1200 g of said second elastomer-modified composition per square meter, and (d) a fourth layer consisting of asphalt pavement, said fourth layer having a minimum thickness of from 10 mm.

2. The combination of claim 1, wherein said first elastomer modified asphalt composition contains from 8 to 13 weight percent elastomer and further contains from 0.2 to 2 weigh percent tackifier.

3. The combination of claim 2, wherein said tackifier is a terpene resin-type tackifier.

4. The combination of claim 1, wherein said first elastomer and said second elastomer are both styrene-diene thermoplastic block rubber containing from 20 to 40 weight percent bound styrene units.

5. The combination of claim 1, wherein said first emulsion and said second emulsion are prepared with an emulsifier consisting of the sodium salt of tall oil.

6. The combination of claim 1, wherein said aggregate particles have a maximum particle size of less than 10 mm.

7. The combination of claim 1, wherein said first asphalt and said second asphalt both have a penetration value of from 65 to 600 dmm.

8. The combination of claim 1, wherein the composition of said asphalt pavement comprises from 5 to 12 weight percent of said second elastomer-modified asphalt composition and 95 to 88 weight percent mineral aggregate.

9. The combination of claim 1, wherein said second elastomer-modified asphalt composition contains from 0.07 to 2.0 weight percent sulfur.

* * * * *